United States Patent [19]

Cataudella

[11] Patent Number: 4,562,643

[45] Date of Patent: Jan. 7, 1986

[54] ALL IN ONE SHAVER

[76] Inventor: John Cataudella, c/o F. Cannati, 2317 Westlake Ct., Oceanside, N.Y. 11572

[21] Appl. No.: 539,092

[22] Filed: Oct. 5, 1983

[51] Int. Cl.[4] ..... B26B 21/44

[52] U.S. Cl. ..... 30/41; 30/86

[58] Field of Search ..... 30/41, 86, 90; 222/103, 222/95, 340

[56] References Cited

U.S. PATENT DOCUMENTS

| | | | |
|---|---|---|---|
| 1,950,769 | 3/1934 | Baar | 30/41 |
| 2,790,234 | 4/1957 | Goldstein | 30/41 |
| 2,795,356 | 6/1957 | Tschumy | 222/95 |
| 4,228,587 | 10/1980 | Bennett | 30/41 |

FOREIGN PATENT DOCUMENTS

| | | | |
|---|---|---|---|
| 162696 | 5/1955 | Australia | 222/103 |
| 2426549 | 12/1979 | France | 30/41 |
| 490808 | 8/1937 | United Kingdom | 30/41 |

*Primary Examiner*—Douglas D. Watts

*Attorney, Agent, or Firm*—Richard L. Miller

[57] ABSTRACT

An all in one shaver is provided and consists of a housing that has a hollow chamber containing a quantity of shave gel therein and an exit port, a device for forcing the shave gel through the hollow chamber of the housing and out of the exit port and a razor secured to the housing and extending diagonally downwardly in a direction away from the exit port of the housing.

2 Claims, 7 Drawing Figures

ALL IN ONE SHAVER

BACKGROUND OF THE INVENTION

The instant invention relates generally to razors and more specifically it related to an all in one shaver combining a razor and shave gel dispenser of a size convenient for carrying.

Numerous razors have been provided in prior art that are adapted to dispense shaving cream. For example, U.S. Pat. Nos. 2,669,017; 2,790,234 and 4,074,428 all are illustrative of such prior art. While these units may be suitable for the particular purpose to which they address, they would not be as suitable for the purposes of the present invention as heretofore described.

SUMMARY OF THE INVENTION

A principle object of the present invention is to provide an all in one shaver that has all the elements necessary for moistening and shaving the face.

Another object is to provide an all in one shaver that has a housing containing shave gel therein that can be replaceable when the shave gel is completely used.

An additional object is to provide an all in one shaver that has a device within the housing for forcing the shave gel out.

A further object is to provide an all in one shaver that is simple and easy to use.

A still further object is to provide an all in one shaver that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE INVENTION

Figure 1:
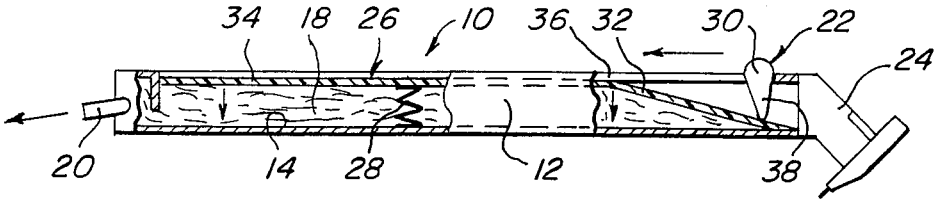
FIG. 1 is a side elevational view partly in section of a first embodiment, of the invention.

Turning now descriptively to the drawings, in which similar reference characters denote similar elements throughout the several views, FIG. 1 illustrates an all in one shaver 10 that consists of a housing 12 that has a hollow chamber 14 containing a quantity of shave gel 18 therein and an exit port 20. A device 22 is provided for forcing the shave gel 18 through the hollow chamber 14 of the housing 12 and out of the exit port 20. A razor 24 is secured to the housing 12 and extends diagonally downward laterally therefrom in a direction away from the exit port 20 of the housing 12.

The device 22 consists of a flexible leaf spring 26, a spiral spring 28 and a button 30. The leaf spring 26 has a bent portion 32 and is placed longitudinally within the chamber 14 of the housing 12. The spiral spring 28 is placed transversely within the chamber 14 of the housing 12 to bias other portion 34 of the leaf spring 26 against the housing 12. The button 30 slideably travels on the housing 12 that has a slot track 36. The button 30 has an internal follower 38 to engage the bent portion 32 of the leaf spring 26 to press the leaf spring down forcing the shave gel 18 through the hollow chamber 14 of the housing 12 and out of the exit port 20.

Figure 2:
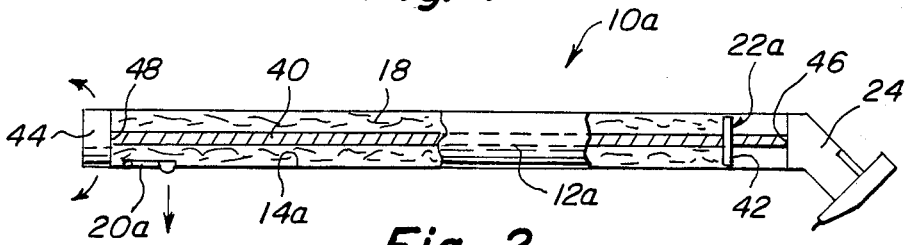
FIG. 2 through 5 are diagrammatic side elevational views partly in section of four other embodiments of the invention.
Figure 6:
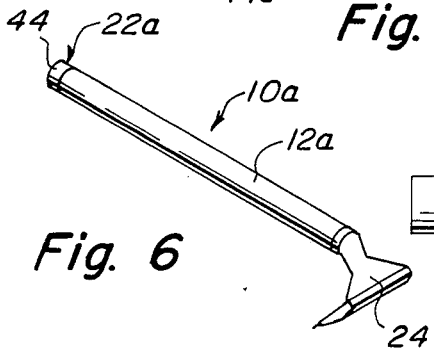
FIG. 6 is a perspective view of one embodiment with the invention incorporated therein.

FIGS. 2 and 6 show a modified all in one shaver **10*a* that has a device 22*a*. The device 22*a* consists of a longitudinally spiral screw shaft 40, a piston 42 and a knob 44. The shaft 40 is rotatively affixed at one end 46 to the housing 12*a*. The piston 42 is threadably mounted to the shaft 40. The knob 44 is affixed to other end 48 of the shaft 40. When the knob 44 is rotated the piston 42 will move towards the knob 44 forcing the shave gel 18 through the hollow chamber 14*a* of the housing 12*a* and out of the exit port 20*a***.

Figure 3:
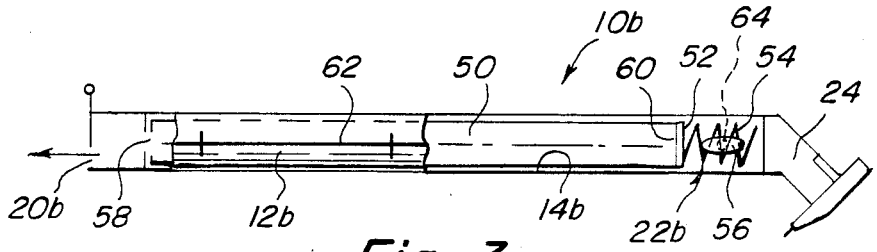

FIG. 3 shows a modified all in one shaver **10*b* that has a device 22*b*. The device 22*b* consists of a flexible tube 50, a plate 52, a spiral spring 54 and a button 56. The flexible tube 50 has an open end 58, containing the shave gel 18 which is placed longitudinally within the chamber 14*b* of the housing 12*b* with the open end 58 facing the exit port 20*b*. The plate 52 is placed adjacent a closed end 60 of the flexible tube 50 within the chamber 14*b* of the housing 12*b*. The spiral spring 54 is placed adjacent the plate 52 within the chamber 14*b* of the housing 12*b*. The button 56 slideably travels on the housing 12*b* that has a slot track 62. The button 56 has an internal projection 64 to engage the spring 54 to press the plate 52 into the flexible tube 50 forcing the shave gel 18 out of the open end 58 through the hollow chamber 14*b* of the housing 12*b* and out of the exit port 20*b***.

Figure 4:
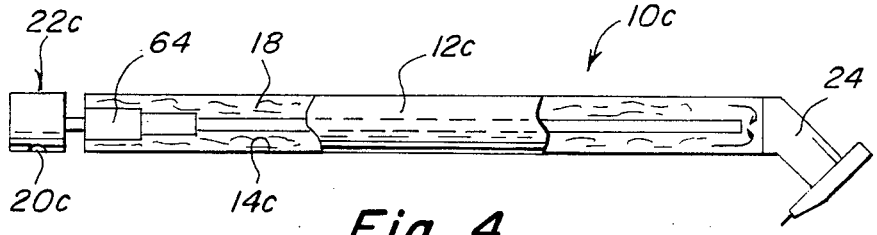

In FIG. 4 the all in one shaver **10*c* has a device 22*c* for forcing the shave gel 18 through the hollow chamber 14*c* of the housing 12*c* and out of the exit port 20*c* that is a spray pump 65**.

Figure 5:
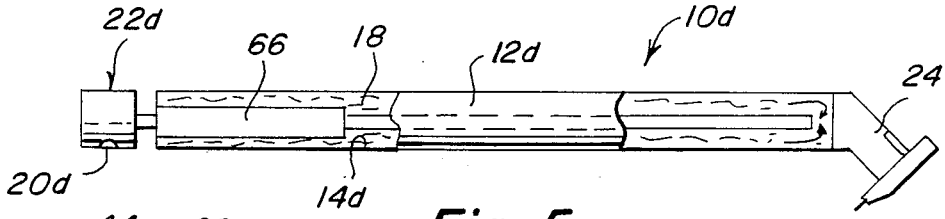

In FIG. 5 the all in one shaver **10*d* has a device 22*d* for forcing the shave gel 18 through the hollow chamber 14*d* of the housing 12*d*; and out of the exit port 20*d* that is a hand pump 66**.

Figure 7:
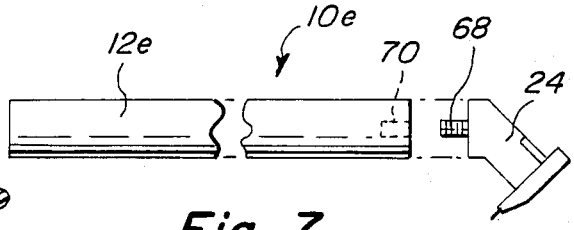
FIG. 7 is an exploded side elevational view to show the replaceable housing feature of the invention.

The razor 24 in the all in one shaver **10*e* in FIG. 7 contains a threaded shaft 68 removably secured to a threaded aperture 70 in 12*e* whereby the housing 12*e* can be replaced by a new refill housing when all the shaving gel 18** is used up.

The housing 12 in FIG. 1 is square in its cross sectional shape. The housings **12*a* through 12*e* are round in their cross sectional shape, however it should be understood that the housing cross section might be fabricated in any number of convenient shapes. The all in one shavers 10 and 10*a* through 10*a*** can be made out of plastic, metal or any durable material.

To use the all in one shaver **10–10*d* all a person has to do is activate the device 22–22*d* to force the shave gel 18 out of the exit port 22–22*d*. The shave gel 18 can then be placed onto the skin to be shaved by razor 24**. The shave gel can be used for about two shaves before a refill is needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An all in one shaver which comprises:

(a) a housing having a hollow chamber, for retaining a quantity of shave gel, and an exit port;

(b) means for forcing the shave gel out of the exit port;

(c) a razor secured to said housing and extending diagonally downwards therefrom in a direction away from the exit port of said housing, wherein said means for forcing the shave gel out of the exit port comprises:

(d) a flexible tube having an open end containing the shave gel placed longitudinally within the chamber of said housing with the open end facing the exit port;

(e) a plate closing the other end of said flexible tube within the chamber of said housing;

(f) a spiral spring placed adjacent said plate within the chamber of said housing; and (g) a button spaced apart from said plate by such spiral spring, and which slidably travels on said housing having a slot track, said button having an internal projection to engage said spring causing said spring to press said plate into said flexible tube forcing the shave gel out of the open end through the hollow chamber of said housing and out of the exit port.

2. An all in one shaver as recited in claim 1 wherein said razor comprises a threaded shaft removably secured to said housing whereby said housing can be replaced by a new refill housing, when the shave gel contained within is spent.

* * * * *